US005839469A

United States Patent [19]

Burke

[11] Patent Number: 5,839,469

[45] Date of Patent: Nov. 24, 1998

[54] SOLENOID VALVE FOR STARTING FLUID INJECTION SYSTEM

[75] Inventor: James O. Burke, Richmond, Ill.

[73] Assignee: Kold Ban International, Ltd., Lake In The Hills, Ill.

[21] Appl. No.: 798,713

[22] Filed: Feb. 12, 1997

[51] Int. Cl.[6] ..... F02M 1/16

[52] U.S. Cl. ..... 137/550; 251/144; 251/127; 123/179.8

[58] Field of Search ..... 137/550, 614.19; 231/129.15, 129.2, 129.21, 144, 127; 123/179.8

[56] References Cited

U.S. PATENT DOCUMENTS

| | | | |
|---|---|---|---|
| 2,887,255 | 5/1959 | Bauerlein | 251/129.21 X |
| 3,007,672 | 11/1961 | Tischler | 251/129.21 |
| 3,189,014 | 6/1965 | Kus | 123/179.8 X |
| 4,202,309 | 5/1980 | Burke | 123/179.8 |
| 4,326,485 | 4/1982 | Burke | 123/179.8 |
| 4,346,683 | 8/1982 | Burke | 123/179.8 |
| 4,360,037 | 11/1982 | Kendall | 137/242 |
| 4,386,588 | 6/1983 | Drenner | 123/179.8 |
| 4,512,587 | 4/1985 | Burke et al. | 277/205 |
| 4,774,916 | 10/1988 | Smith | 123/179.8 |
| 4,887,769 | 12/1989 | Okamoto et al. | 239/493 |
| 5,102,095 | 4/1992 | Schmitt-Matzen et al. | 251/127 X |
| 5,145,146 | 9/1992 | Matsushima | 251/129.02 |
| 5,163,468 | 11/1992 | Robinson et al. | 137/315 |
| 5,170,945 | 12/1992 | Daly et al. | 239/585.4 |
| 5,375,811 | 12/1994 | Reinicke | 251/129.16 |
| 5,388,553 | 2/1995 | Burke et al. | 123/179.8 |

OTHER PUBLICATIONS

Spartan Scientific, "Series 4100 Air–Sol 2–Way Solenoid Valves" (1996).

O'Keefe Controls Co., "Precision Fluid Restrictors Recent New Editions" (1996).

Newmet Krebsoge, "Chromatographic Products" (1996).

*Primary Examiner*—John Rivell

*Attorney, Agent, or Firm*—Brinks Hofer Gilson & Lione

[57] ABSTRACT

A solenoid valve for a starting fluid injection system includes a passageway that interconnects the canister valve of the canister with a conduit that transmits starting fluid to the engine. An armature is mounted to slide in the passageway between an open and a closed position. Two valve seats are provided on opposite sides of the armature. The first valve seat is near the exit port of the passageway and is closed by the armature when the solenoid coil is not energized. The second valve seat is an annular O-ring gland designed to receive an O-ring that seals against the exterior of the canister around the threaded neck. When the coil is energized, the armature is moved to the open position, in which both the first valve and the canister valve are opened. A filter and an orifice-defining element are mounted in the valve body between the first valve seat and the exit port. The valve can operate with a coil current as low as 1 amp at 12 VDC.

19 Claims, 3 Drawing Sheets

SOLENOID VALVE FOR STARTING FLUID INJECTION SYSTEM

BACKGROUND OF THE INVENTION

This invention relates to an improved solenoid valve for a starting fluid injection system for internal combustion engines.

U.S. Pat. No. 4,202,309 discloses one commercially successful staring fluid injection system. This patent is assigned to the assignee of the present invention, and the disclosed system has met with considerable commercial success. In such a system, starting fluid contained in a canister is dispensed via a solenoid valve to an injector, and the injector is mounted to spray starting fluid into a suitable portion of the internal combustion engine.

One typical solenoid valve of the prior art draws approximately 12 amps at 12 VDC, and therefore requires a current driver to operate properly in many applications. This prior-art solenoid valve uses a filter and an orifice-defining element mounted in the conduit that interconnects the solenoid valve with the injector. This arrangement has been the source of maintenance problems in the past, due to clogging or failure of the filter, or tampering or removal of the orifice-defining element. Additionally, this prior-art solenoid valve uses an elastomeric washer positioned between the end face of the threaded neck of the canister and the body of the solenoid valve. Such an elastomeric washer compresses in use, and therefore does not provide a precisely controlled registration between the canister and the solenoid valve.

Modern starting fluid injection systems utilize controllers designed to terminate the flow of starting fluid promptly on command. The prior-art solenoid valve discussed above has a substantial internal volume, and this internal volume is vented to the engine after the canister valve is closed. In applications where this venting has been considered undesirable, an injector valve has been mounted closely adjacent to the engine to provide more precise control over the time at which the flow of starting fluid into the engine is stopped. However, the use of such an injector valve increases the complexity and cost of the system.

The preferred embodiment of the present invention described below addresses each of these drawbacks of the prior art.

SUMMARY OF THE INVENTION

According to a first aspect of this invention, a solenoid valve of the general type described above includes a valve seat around the valve body passageway. The solenoid armature is mounted in the passageway upstream of the valve seat to slide between a closed position, in which the armature seals the passageway at the valve seat, and a open position, in which the armature opens the passageway at the valve seat and the armature opens the canister valve. Because the armature closes the passageway at the valve seat (downstream of the armature), the volume of starting fluid contained in the solenoid valve does not vent to the engine after the solenoid is de-energized.

According to a second aspect of this invention, a solenoid valve for a starting fluid injection system is provided with a valve body that includes a gland for an annular elastomeric seal such as an O-ring. This gland is formed around the passageway of the valve body, and it faces the canister such that the elastomeric seal contacts the exterior surface of the canister, radially outwardly from the threaded neck of the canister. This approach allows precise registration between the canister and the valve body.

According to a third aspect of this invention, a solenoid valve for a starting fluid injection system is provided with a filter and an orifice-defining element, both of which are mounted inside the valve body between the armature and the exit end of the passageway. This arrangement allows the use of an effective, large-diameter filter, and it makes it relatively difficult to alter or tamper with the orifice-defining element in an unauthorized manner.

DETAILED DESCRIPTION OF THE PRESENTLY PREFERRED EMBODIMENTS

Figure 1:
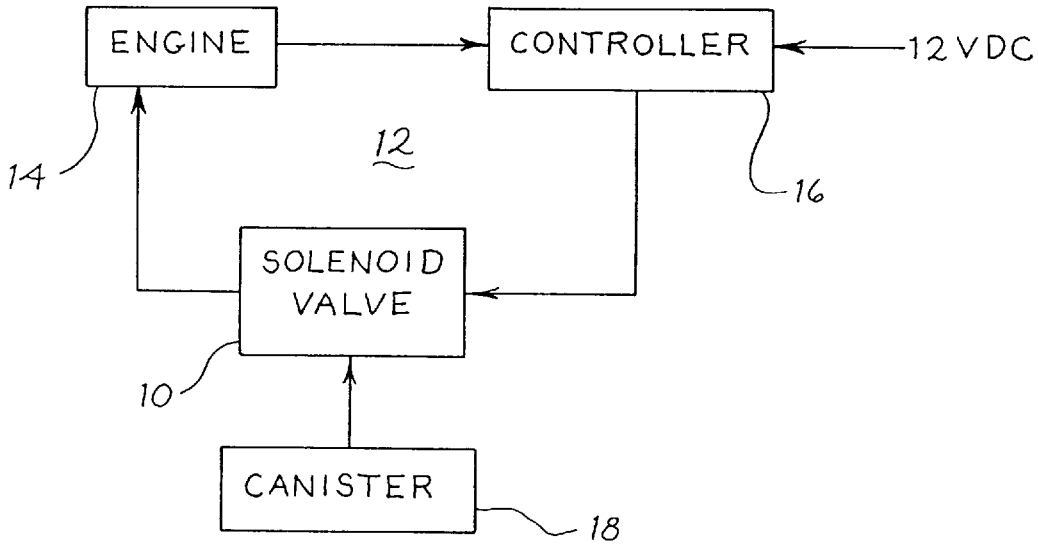
FIG. 1 is a schematic view of a starting fluid injection system that incorporates a presently preferred embodiment of this invention.

Turning now to the drawings, FIG. 1 shows a solenoid valve 10 included in a starting fluid injection system 12 for an internal combustion engine 14. The system 12 includes an electronic controller 16 which is supplied with sensor signals from the engine 14. The controller 16 uses the sensor signals to determine when to open the solenoid valve 10 in order to allow pressurized starting fluid contained in a canister 18 to pass through the solenoid valve 10 into an injector (not shown) in the engine. It should be understood that the engine 14, the controller 16, and the canister 18 may all be conventional prior-art devices, and that they have been described here merely to illustrate the environment of the present invention. The invention itself is embodied in the structure and operation of the solenoid valve.

Figure 2:
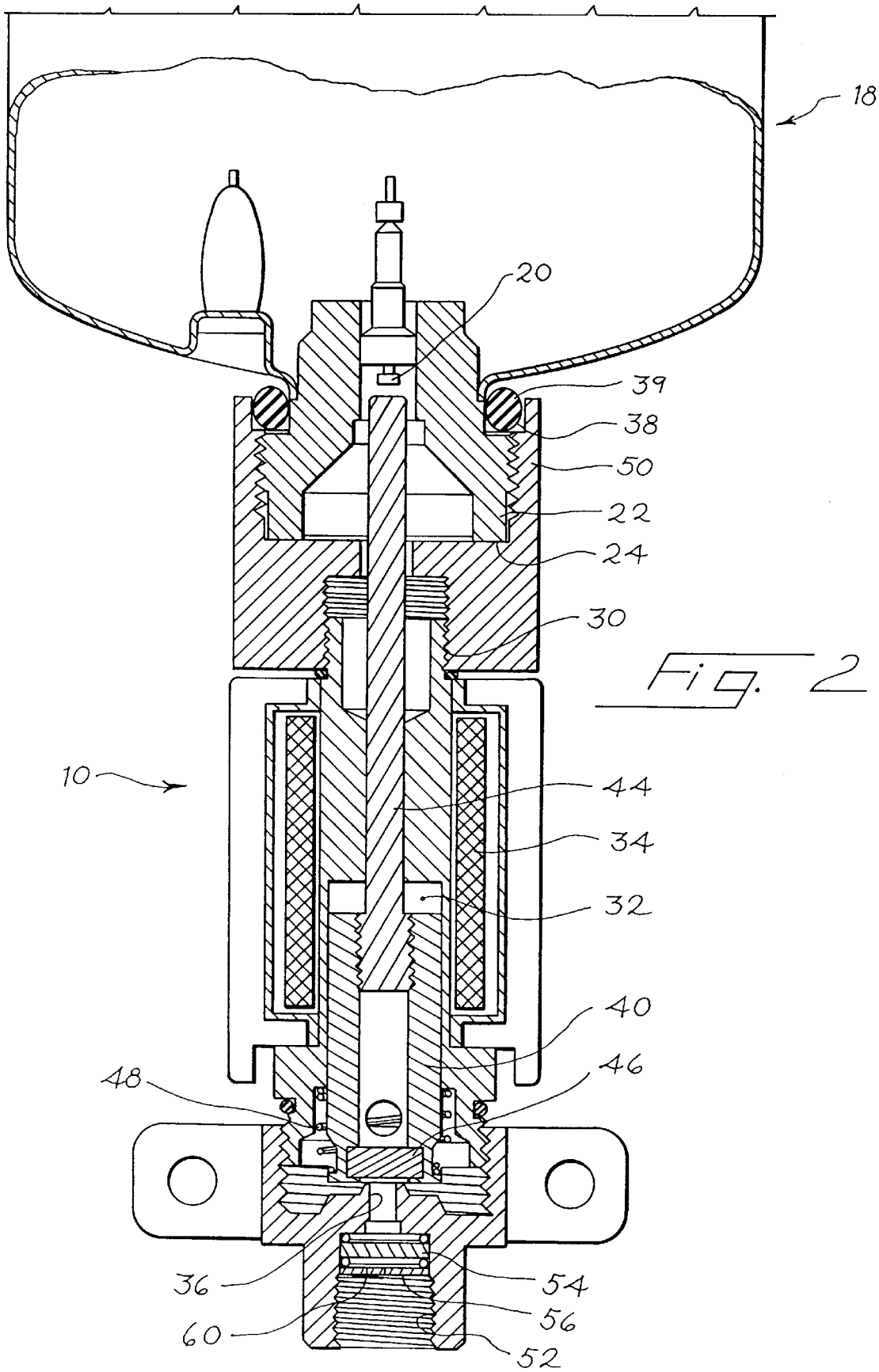
FIG. 2 is a cross-sectional view of the solenoid valve of FIG. 1 in the closed position.

Turning to FIG. 2, the solenoid valve 10 includes a valve body 30 that defines a passageway 32. The passageway 32 is surrounded by an electrical coil 34, and the valve body 30 provides first and second valve seats 36, 38 near opposite ends of the passageway 32. Each of the valve seats 36, 38 extends around the respective portion of the passageway 32.

An armature 40 is mounted between the valve seats 36, 38 to slide in the passageway 32. This armature 40 defines a pair of axially extending grooves (not shown in FIG. 2) positioned at the lateral edges of the armature 40. A rod 44 is rigidly mounted to the armature 40, and this rod is positioned closely adjacent to a canister valve 20 included in the canister 18. The opposite end of the armature 40 carries an elastomeric disc 46 that cooperates with the first valve seat 36 to selectively open and close the passageway 32. A spring 48 is mounted in the passageway 32 to bias the armature 40 to the closed positioned shown in FIG. 2, in which the elastomeric disc 46 closes the passageway 32 at the first valve seat 36.

The end of the passageway 32 adjacent to the canister 18 terminates in a threaded collar 50 that is shaped to receive a threaded neck 22 included in the canister 18.

As shown in FIG. 2, the second valve seat 38 is formed as an annular groove that forms a gland for an elastomeric seal such as an O-ring 39. The groove of the second valve seat 38 faces the canister 18, and captures the O-ring 39 to prevent undesired lateral spreading. When the threaded neck 22 is screwed into the threaded collar 50, the O-ring 39 is pressed between the second valve seat 38 and the exterior surface of the canister 18 to create an effective seal. The threaded neck 22 of the canister 18 defines an end face 24, and the valve body 30 is designed to provide metal-to-metal contact between the end face 24 and the valve body 30 when the canister 18 is fully seated. This arrangement limits the maximum compression applied to the O-ring 39, and it ensures repeatable and precise registration between the canister 18 and the valve body 30.

The end of the passageway 32 opposite the second valve seat 38 defines an exit port 52, which is threaded to receive a conventional fitting for a conduit that interconnects the valve body 30 with the injector (not shown) in the engine. The valve body 30 defines a mounting structure for a porous disk that acts as a filter 54 and for an orifice-defining element 56. Both the filter 54 and the orifice-defining element 56 are positioned between the first valve seat 36 and the exit port 52, and the filter 54 is positioned upstream of the orifice-defining element 56 to reduce or prevent clogging of the orifice 60. The orifice 60 limits the flow rate of starting fluid out of the passageway 32 and into the conduit.

Figure 3:
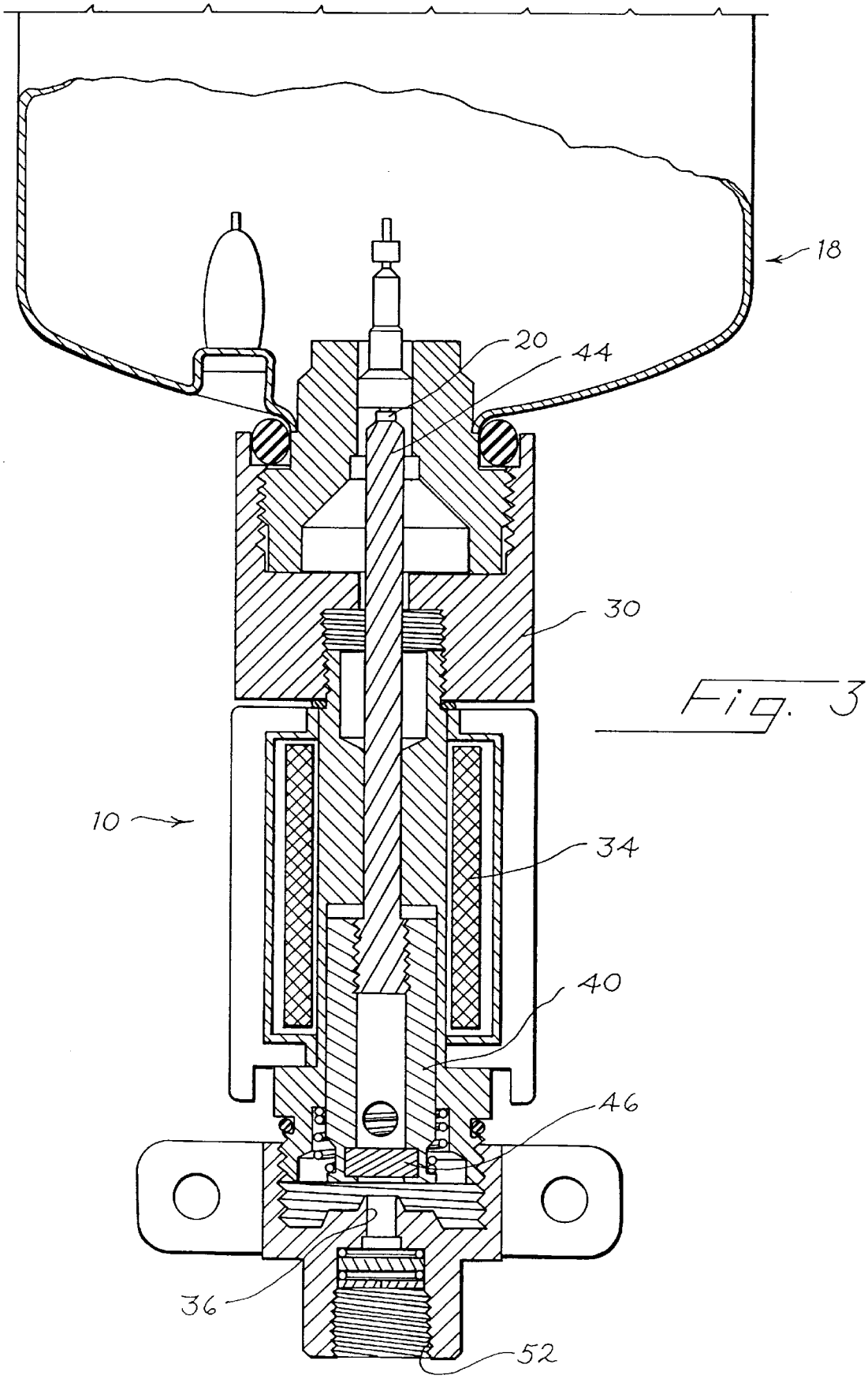
FIG. 3 is a cross-sectional view of the solenoid valve of FIG. 1 in the open position.

The armature 40 is normally biased to the closed position of FIG. 2 by the spring 48. In this position, the first valve seat 36 is closed by the elastomeric disc 46, and the canister valve 20 is closed. When current is passed through the coil 34, the armature 40 is moved toward the canister valve 20 to an open position as shown in FIG. 3, in which the valve at the first valve seat 36 is opened, and the rod 44 depresses the canister valve 20 to open the canister valve 20. The axial grooves in the armature 40 allow starting fluid to flow past the armature 40 when the armature is in the open position.

It has been surprisingly discovered that the solenoid valve 10 can operate reliably throughout the desired range of temperatures when energized by a current through the coil 34 of no more than about 1 amp at 12 VDC. This relatively low current is sufficient to move the armature 40 to open the valve seat 36 and to cause the rod 44 to depress the canister valve 20 to open the canister valve 20.

A number of features are believed to contribute to the reliable operation of the valve 10 at such a low energizing current. First, the first valve seat 36 and the elastomeric disc 46 form a valve that can be opened with relatively little force. Second, once the valve formed at the first valve seat 36 is opened, this valve is no longer in physical contact with the armature 40, and does not frictionally inhibit movement of the armature 40. Third, the precise registration discussed above of the canister 18 with respect to the valve body 30 allows a controlled amount of free travel (a stroke of at least about 0.050 inch in this embodiment) for the armature 40 before the rod 44 contacts the canister valve 20. This controlled stroke allows the armature 40 to develop sufficient momentum to open the canister valve 20 reliably.

Because the solenoid coil 34 operates at the relatively low current of 1 amp, the controller 16 will be able to drive the solenoid coil 34 directly in many applications, without requiring an auxiliary current amplifier. By eliminating the current amplifier that has often been used in the past, the overall cost and complexity of the system are substantially reduced.

Another advantage of the solenoid valve 10 is that the first valve seat 36 is positioned closely adjacent to the exit port 52. For this reason, when current is removed from the coil 34, the closing of the valve at the first valve seat 36 promptly prevents starting fluid contained in the passageway 32 in the region of the armature 40 from venting into the engine. The volume of the conduit between the valve 10 and the injector can be made relatively small, and in many applications the use of the valve at the first valve seat 36 provides sufficiently prompt termination of flow to eliminate the need for a separate valve at the injector. Of course, by eliminating the need for such a separate valve, the cost and the complexity of the system are minimized.

The sealing arrangement between the solenoid valve 10 and the canister 18 provides further advantages. First, the O-ring 39 provides an effective seal with the canister 18 and it provides precise and repeatable registration between the valve body 30 and the canister 18. Since the O-ring 39 forms the only elastomeric seal between the canister 18 and the solenoid valve 10, it is the metal-to-metal contact between the end face 24 and the valve body 30 that dictates the final position of the canister 18. The seal is relatively fool proof, because it is unlikely that two O-rings 39 would be mounted between the solenoid valve 10 and the canister 18. This is in contrast to elastomeric washers of the prior art, which can be inadvertently stacked one on top of the other within the valve body 30.

Furthermore, because the solenoid valve 10 incorporates both the filter 54 and the orifice-defining element 56 within the valve body 30, it is relatively difficult for an unauthorized person to tamper with or bypass the orifice-defining element 56. The placement of the filter 54 allows the use of a relatively large-diameter, large-area porous disc, which contributes to good long-term filtering. This arrangement allows the user to select the conduit and associated fittings at will. It eliminates the need for an additional filter/orifice housing outside the valve body 30, which again contributes to reduced complexity and cost of the overall system.

Simply by way of example, the following elements have been found suitable for use in the solenoid valve 10.

The valve coil 34 and the armature 40 can be provided with minimal air gaps and a design stroke of about 0.050 inch. The valve coil and armature manufactured by Spartan Scientific as Part No. 4100 series may be found suitable. The elastomeric disc 46 and the O-ring 39 can be formed of a appropriate elastomeric material such as Fluorocarbon Rubber (FKM) sold under the trade name Viton. The filter 54 can be of a type sold by Newmet Krebsoge as a chromatographic disc (0.50 O.D.) and the orifice-defining element 56 can be of the type sold by O'Keef Controls Co. (Monroe, Conn.) as Type R4. The diameter of the orifice 60 can vary widely with the application, but may for example be 0.008 inch.

Of course, it should be understood that a wide range of changes and modifications can be made to the preferred embodiment described above. For example, various features of the solenoid valve 10 (including the placement of the first valve seat 36, the use of an elastomeric seal gland adjacent the canister, and the use of the orifice-defining element and the filter within the valve body) can all be used separately from one another rather than in combination as discussed above. Also, dimensions, layout, proportions, and materials can all be adapted as appropriate for the particular application.

It should be understood that the foregoing detailed description has described only one of the many forms that the present invention can take. It is therefore intended that the detailed description be regarded as illustrative rather than limiting, and that it be understood that it is only the following claims, including all equivalents, that are intended to define the scope of this invention.

I claim:

1. A solenoid valve for a starting fluid injection system for an internal combustion system, said system comprising a pressurized starting fluid canister comprising a canister valve, said solenoid valve comprising:

a valve body comprising a passageway, a first valve seat around the passageway, and a second valve seat around the passageway, said second valve seat adapted to form part of a seal against the canister around the canister valve;

a solenoid coil mounted in the valve body around the passageway;

a solenoid armature mounted in the passageway to slide between a closed position, in which the armature seals the passageway at the first valve seat and the armature allows the canister valve to close, and an open position, in which the armature opens the passageway at the first valve seat and the armature opens the canister valve;

an orifice-defining element disposed in the passageway of the valve body near the first valve seat, said orifice-defining element limiting starting fluid flow through the passageway; and a filter mounted in the passageway inside the valve body between the first valve seat and the orifice-defining element;

said solenoid coil, when engaged, moving the armature to the open position;

said first and second valve seats positioned on opposed sides of the armature.

2. The invention of claim 1 further comprising a spring biasing the armature to the closed position.

3. The invention of claim 1 wherein the passageway comprises an exit port, and wherein the first valve seat is interposed between the armature and the exit port.

4. The invention of claim 1 wherein the armature comprises an elastomeric disc positioned to seal against the first valve seat.

5. The invention of claim 1 wherein the coil draws no more than about 1 amp at about 12 VDC.

6. The invention of claim 1 wherein the armature slides freely over a stroke between the closed position and contact with the canister valve, and wherein the stroke is at least about 0.050 inch in length.

7. The invention of claim 1 wherein the second valve seat comprises an annular groove facing the canister, said annular groove forming a gland for an annular elastomeric seal.

8. The invention of claim 7 wherein the valve body comprises internal threads configured to engage a threaded neck of the canister, and wherein the threaded neck comprises an end face that meets the valve body in metal-to-metal contact when the threaded neck is completely seated in the valve body via the internal threads, thereby providing precise registration between the canister and the valve body.

9. The invention of claim 1 wherein the first valve seat is positioned in the valve body such that the armature moves away from the first valve seat before the armature opens the canister valve.

10. A solenoid valve for a starting fluid injection system for an internal combustion system, said system comprising a pressurized starting fluid canister comprising a canister valve, said solenoid valve comprising:

a valve body comprising a passageway and internal threads configured to engage a threaded neck of the canister, and wherein the threaded neck comprises an end face that is precisely positioned with respect to the valve body when the threaded neck is completely seated in the valve body via the internal threads, thereby providing precise registration between the canister and the valve body;

a solenoid coil mounted in the valve body around the passageway;

a solenoid armature mounted in the passageway to slide between a closed position and an open position, said armature opening the canister valve in the open position, said solenoid coil, when energized, moving the armature to the open position;

a gland for an annular elastomeric seal, said gland formed around the passageway adjacent the internal threads and facing radially inwardly toward the threaded neck of the canister.

11. The invention of claim 10 wherein the threads of the valve body are interposed between the gland and the armature.

12. The invention of claim 11 wherein the annular elastomeric seal is the only elastomeric seal between the canister and the valve body.

13. The invention of claim 10 wherein the elastomeric seal comprises an O-ring.

14. The invention of claim 10 in combination with the canister, wherein the threaded neck of the canister is received in the internal threads of the valve body, and wherein the annular elastomeric seal is mounted on the neck of the canister and removably received in the gland of the solenoid valve.

15. The invention of claim 10 wherein the end face meets the valve body in metal-to-metal contact when the threaded neck is completely seated in the valve body via the internal threads.

16. A solenoid valve for a starting fluid injection system for an internal combustion system, said system comprising a pressurized starting fluid canister comprising a canister valve, said solenoid valve comprising:

a valve body comprising a passageway;

a solenoid coil mounted in the valve body around the passageway;

a solenoid armature mounted in the passageway to slide between a closed position and an open position, said armature opening the canister valve in the open position, said solenoid coil, when energized, moving the armature to the open position;

a filter mounted in the passageway inside the valve body between the armature and an exit end of the passageway; and an orifice-defining element mounted in the passageway inside the valve body between the filter and the exit end, said orifice-defining element limiting starting fluid flow through the passageway;

said filter and orifice-defining element mounted to the valve body internally of the exit end of the passageway.

17. The invention of claim 16 wherein the filter comprises a porous disc having a diameter of at least about one half inch.

18. The invention of claim 16 wherein the filter and orifice-defining element are mounted directly to the valve body.

19. The invention of claim 16 wherein the filter and the orifice-defining element are sealed directly to the valve body.

* * * * *